US006253877B1

(12) United States Patent
Yang

(10) Patent No.: US 6,253,877 B1
(45) Date of Patent: Jul. 3, 2001

(54) INTERNAL COMBUSTION ENGINE PRE-LUBRICATION SYSTEM

(76) Inventor: Hung-Yung Yang, No. 2-2, Tour Luen Li, Luh Gang Chen, Chang Hua Hsien (TW)

( * ) Notice: Subject to any disclaimer, the term of this patent is extended or adjusted under 35 U.S.C. 154(b) by 0 days.

(21) Appl. No.: 09/385,686

(22) Filed: Aug. 30, 1999

(51) Int. Cl.[7] ..... F01M 9/00
(52) U.S. Cl. ..... 184/6.3; 184/7.4; 123/196 S
(58) Field of Search ..... 184/6.3, 7.4, 105.1; 123/196 S, 196 R, 179.5

(56) References Cited

U.S. PATENT DOCUMENTS 3,631,847 * 1/1972 Hobbs, II ..... 128/2 R
4,112,910 * 9/1978 Percy ..... 123/196 S
4,157,744 * 6/1979 Capriotti ..... 184/6.3
4,589,337 * 5/1986 Hardin ..... 101/363
5,147,014 * 9/1992 Pederson ..... 184/6.3
5,244,059 * 9/1993 McLaughlin ..... 184/6.3
5,494,013 * 2/1996 Helbig ..... 123/196 S
5,511,522 * 4/1996 Tran ..... 184/6.3
5,655,495 * 8/1997 Richards ..... 184/6.3
5,694,896 * 12/1997 Melvin ..... 123/196 S

* cited by examiner

*Primary Examiner*—David A. Bucci
*Assistant Examiner*—Chong H. Kim
(74) *Attorney, Agent, or Firm*—Dougherty & Troxell

(57) ABSTRACT

An internal combustion engine pre-lubrication system that operates before a typical internal combustion engine is started, in which engine oil inside the pre-lubrication system is rapidly delivered in advance of actual starting through the main oil duct to the internal combustion components requiring lubrication. When the internal combustion engine starting process occurs, all the engine components operate quicker, piston compression is more optimal, internal combustion engine starting is easier, frictional wear between engine components is reduced, fuel combustion is more complete and thereby complies with exhaust emission standards, and overall internal combustion engine service life is effectively prolonged.

3 Claims, 9 Drawing Sheets

INTERNAL COMBUSTION ENGINE PRE-LUBRICATION SYSTEM

BACKGROUND OF THE INVENTION

1) Field of the Invention

The invention herein relates to an internal combustion engine pre-lubrication system that lubricates all moving components before such an engine is actually started. The internal combustion engine pre-lubrication performance of the present invention enables engine components to operate quicker, provides more optimal piston compression, easier internal combustion engine starting, reduced frictional wear between engine components, more complete fuel combustion and thereby compliance with exhaust emission standards, and the effective prolonging of overall internal combustion engine service life.

2) Description of the Prior Art

While industrial technology has developed significantly in recent years, environmental protection problems such as air pollution, water contamination, and industrial waste pollution have become more serious. Although solutions to these problems can be handled by appropriate treatment, the most effective policy is prevention.

The most likely cause of air pollution now are vehicles and various internal combustion engines. To reduce such air pollution would first of all require complete fuel combustion. However, due to poor internal combustion engine maintenance or utilization beyond the limited years of functional expectancy, it is common to see cars spewing black exhaust smoke along roadways until they finally become inoperable.

When a typical internal combustion engine is not operating, the oil lubricating the internal components flows down to the lower crankcase due to the effect of gravity. Thus, when the internal combustion engine is started once again, some of the engine components are not lubricated for a brief instant, which results in considerable frictional wear that is several thousand times more severe than under lubricated conditions.

Since compact passenger cars and trucks especially are often started and switched off repeatedly a high number of times, the frictional wear of each unlubricated engine component can be become very serious, which is why horsepower is impaired and smoke is emitted after approximately 20,000 kilometers of travel for the duration of the vehicle's usable service life. In comparison, larger passenger and transport vehicles are started less frequently and since most of the internal combustion engine components are kept normally lubricated, such vehicles can be driven for several hundred thousand kilometers.

To reduce air pollution and thereby improve environmental conditions, the automotive industry has gradually introduced battery- and diesel-powered cars. However, the current technology is incapable of effectively overcoming battery storage capacity and acceleration problems, not to mention battery disposal, which could result in yet another major environmental pollution.

As a result, internal combustion engines continue to be relied on to provide motive power, with proper engine maintenance keeping exhaust emissions within standards and thereby reducing air pollution, which is currently the best practical approach.

SUMMARY OF THE INVENTION

The primary objective of the invention herein is to provide an internal combustion engine pre-lubrication system having an oil capacity that involves the addition of approximately 300 cc of engine oil (the exact quantity may be more or less depending on the displacement of the internal combustion engine to which the system is installed) to the total oil volume of an internal combustion engine. When the internal combustion engine is started, engine oil pressure is established and, furthermore, after engine oil flows to all engine components, a minute quantity flows towards the pre-lubrication system. After the internal combustion engine is switched off, the said additional oil volume of approximately 300 cc is stored in the hydraulic cylinder of the pre-lubrication system such that just before the internal combustion engine is started once again, the pre-lubrication system rapidly (within approximately two seconds) injects the 300 cc of engine oil to lubricate all moving components of the internal combustion engine prior to its actual starting. This enables all engine components to operate more quickly, more optimal piston compression, easier internal combustion engine starting, reduced frictional wear between engine components, and more complete fuel combustion and thereby compliance with exhaust emission standards, which are among the innovations of the present invention.

Another objective of the invention herein is to provide an internal combustion engine pre-lubrication system which is capable of injecting the approximately 300 cc of engine oil to lubricate all engine components within a short period each time just before an internal combustion engine is actually started, so that an adequate degree of lubrication is maintained between all operating engine components that reduces friction as well as destructive wear and, furthermore, provides a means whereby engine oil is less likely to pollute which effectively improves upon environmental protection problems and, furthermore, lengthens the mileage between engine oil changes, while maintaining optimal overall performance and prolonging the usable service life of an internal combustion engine, minimizing vehicle as well as engine oil purchase costs and thereby effectively strengthening the overall national economy, which are also among the innovations of the present invention.

Yet another objective of the invention herein is to provide an internal combustion engine pre-lubrication system, wherein the entire pre-lubrication system of the invention herein can be installed at the side of an internal combustion engine without requiring any modification whatsoever to the mechanical structure of various brands of internal combustion engines, its structural scope of application is relatively wide, which is also another innovative aspect of the present invention.

To enable further understanding of the structure, innovations, operation, and other aspects of the invention herein, the brief description of the drawings below is followed by the detailed description of the preferred embodiment.

DETAILED DESCRIPTION OF THE PREFERRED EMBODIMENT

Figure 1:
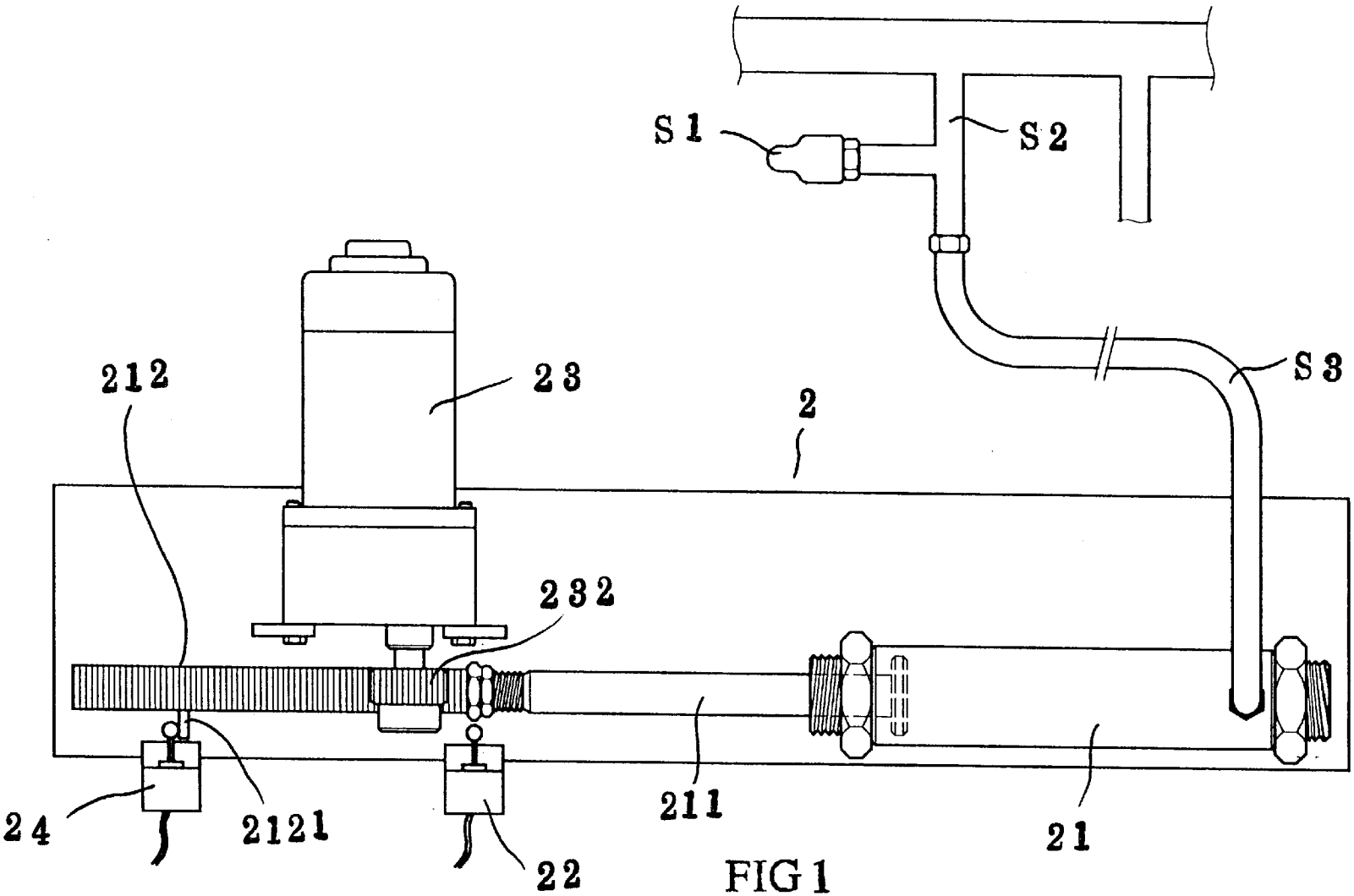
FIG. 1 is an orthographic drawing of the internal combustion engine pre-lubrication system of the invention here as installed on a typical internal combustion engine, with the installation the engine oil pressure switch shown in magnified view.
Figure 2:
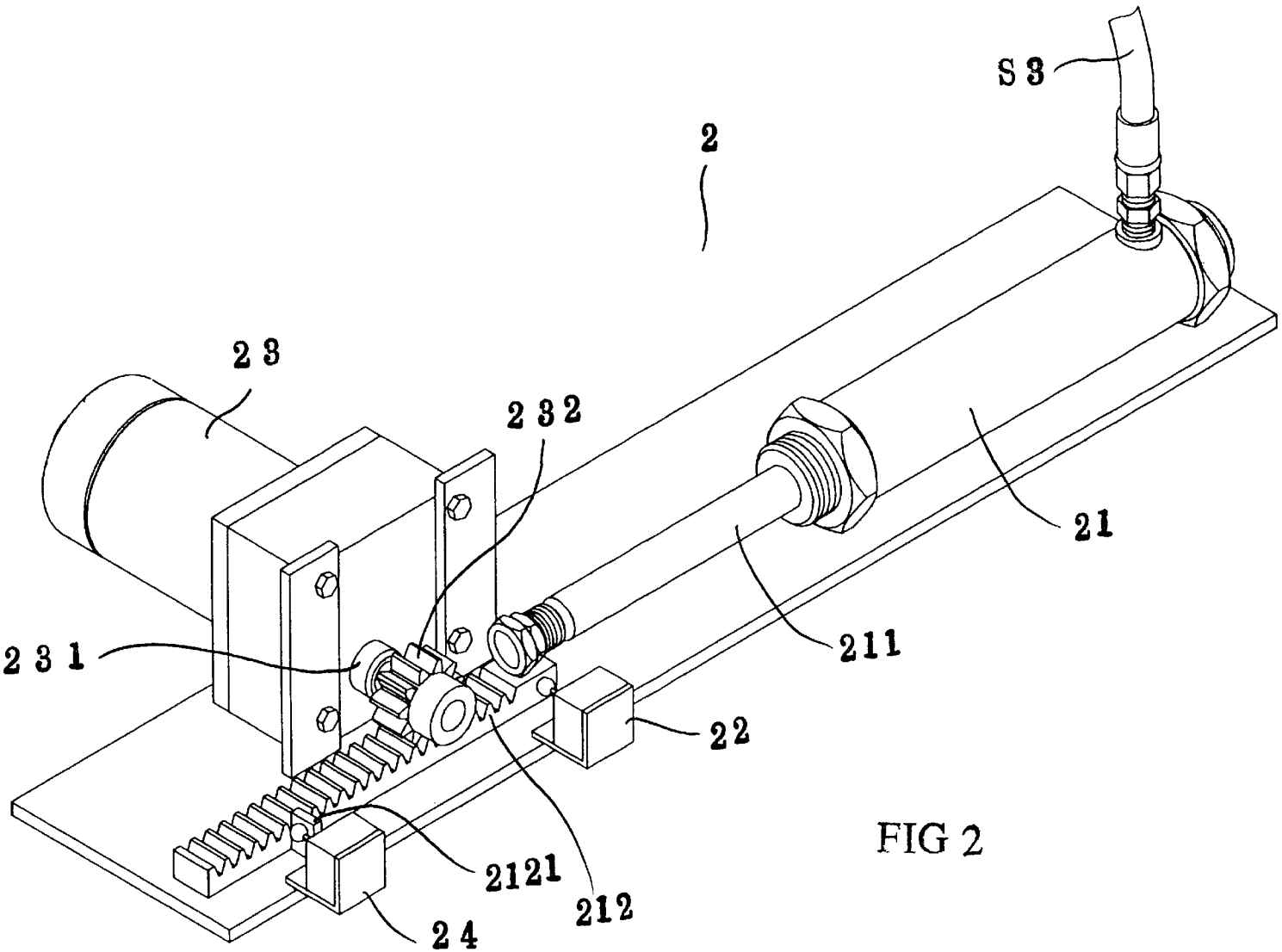
FIG. 2 is an isometric drawing of an embodiment of the internal combustion engine pre-lubrication system of the invention herein.
Figure 3:
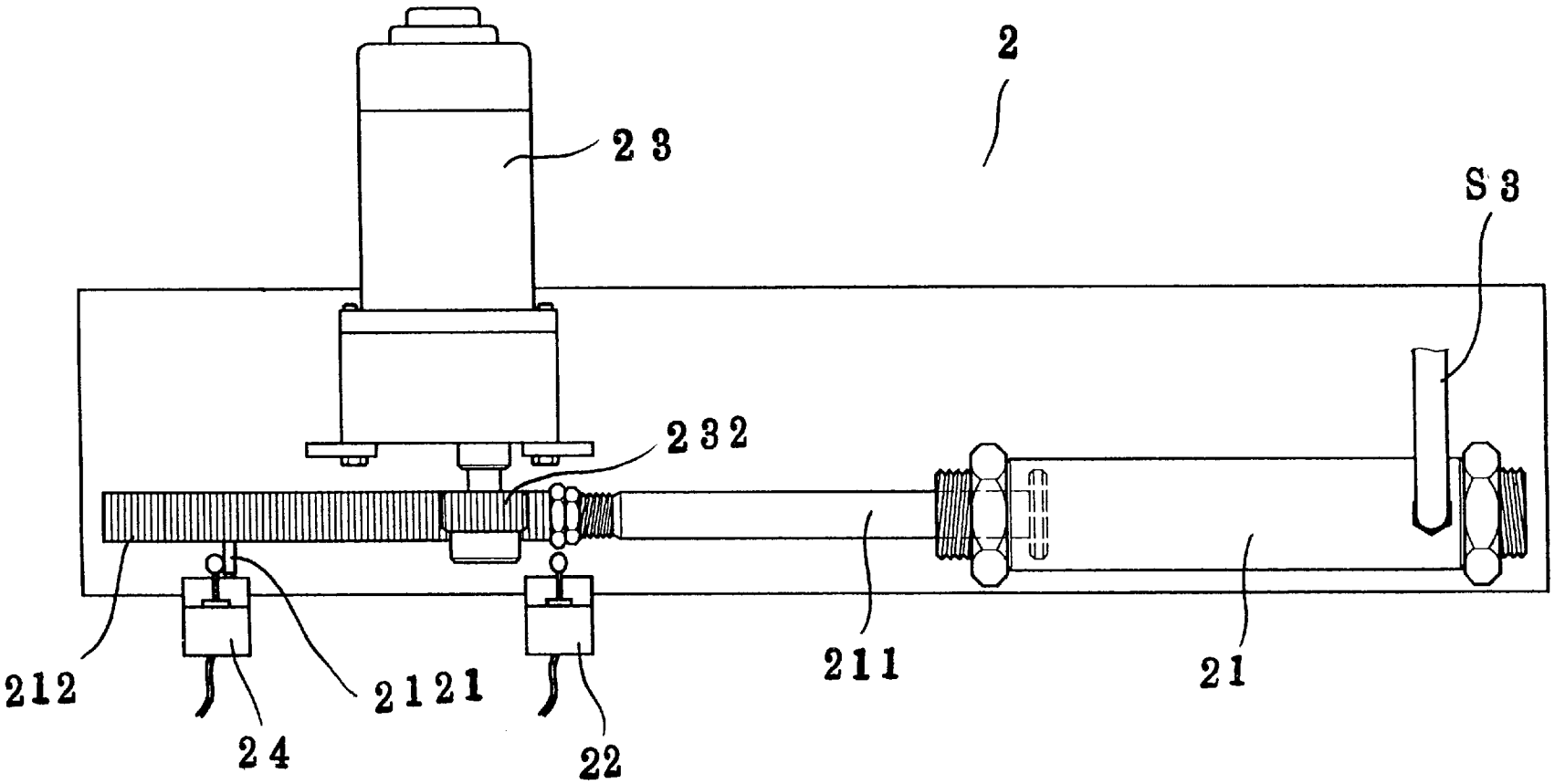
FIG. 3 is an orthographic drawing of the internal combustion engine pre-lubrication system of the invention herein that illustrates starting.
Figure 4:
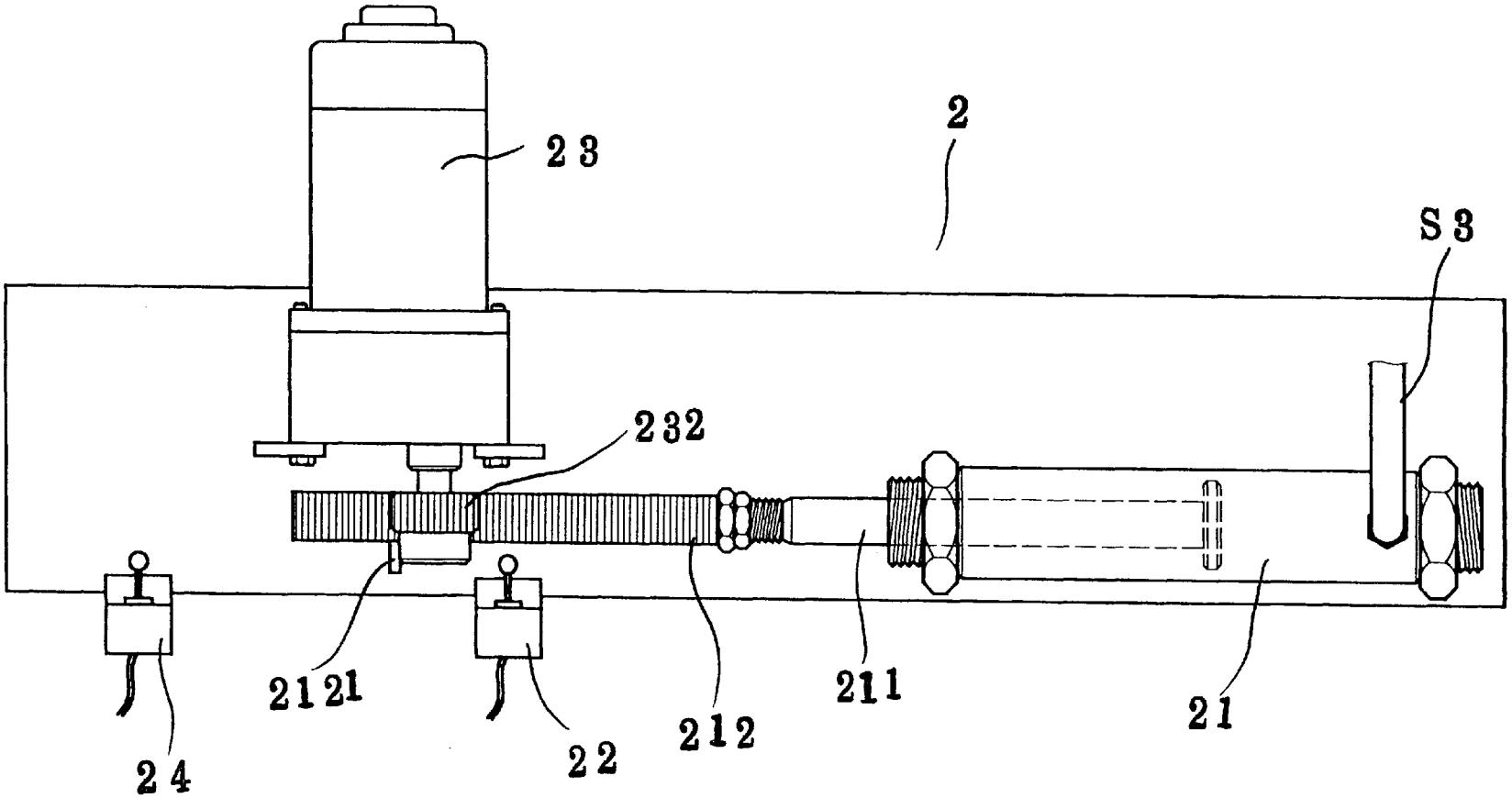
FIG. 4 is an orthographic drawing of the internal combustion engine pre-lubrication system of the invention herein that illustrates just prior to the starting process.
Figure 5:
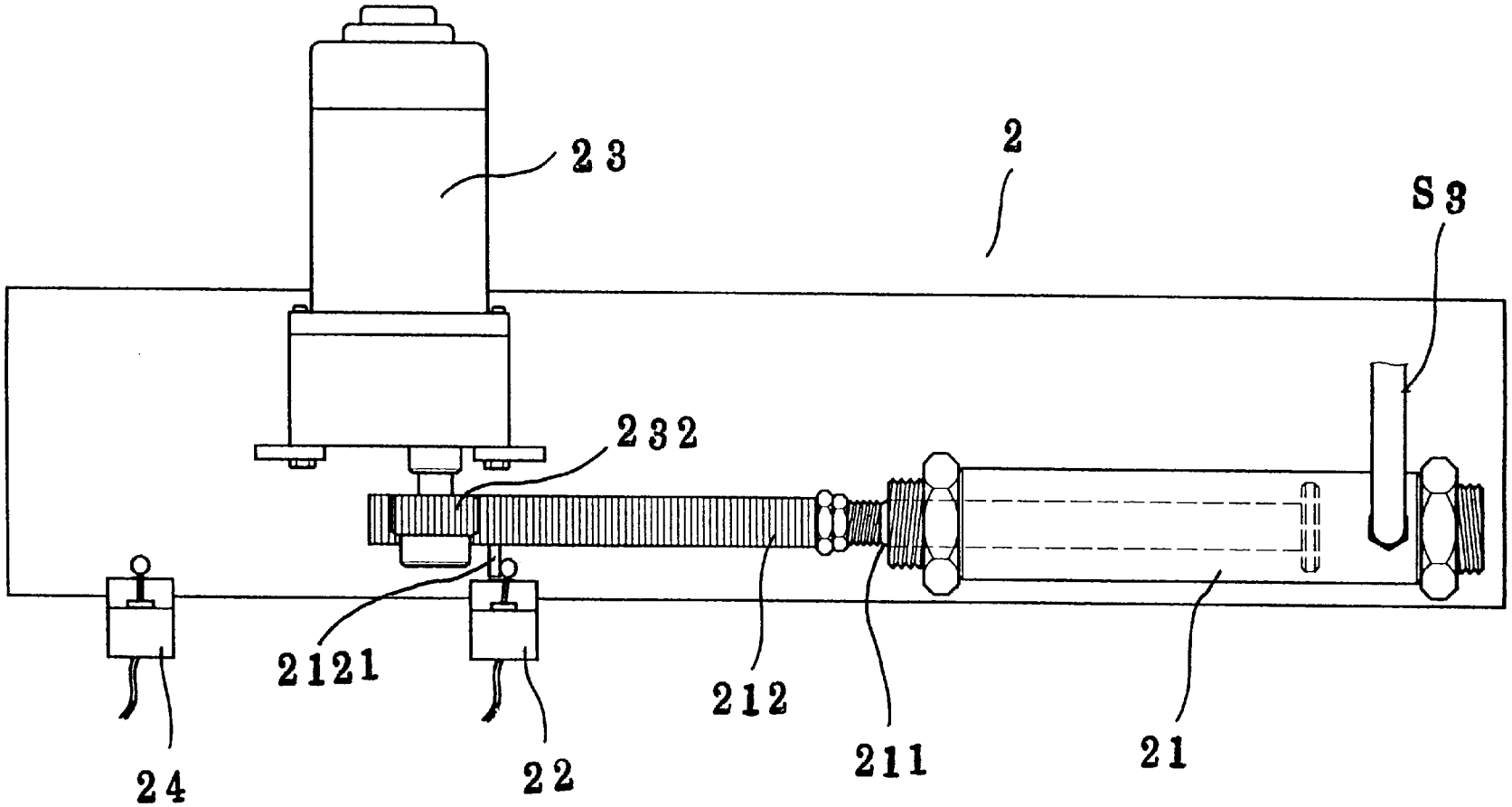
FIG. 5 is an orthographic drawing of the internal combustion engine pre-lubrication system of the invention herein that illustrates (the pre-lubrication system after the starting process.

Referring to Attachment 1, FIG. 1, and FIG. 2, the pre-lubrication system of the invention herein operates when a typical internal combustion engine is started, wherein the oil pump in the oil pan begins to pump engine oil, causing the engine oil to flow through the oil filter and oil cooler, after which the engine oil enters the main oil duct and is delivered to the various moving components of the internal combustion engine (such as the shaft bearings, camshaft bearings, timing gear, timing orifice, and piston orifice, etc. As illustrated in FIG. 1, a three-way connector S2 replaces the oil pressure switch S1 originally conjoined to the main oil duct and after one end of the said three-way connector S2 is connected to the main oil duct and the oil pressure switch S1 is connected to another end, the remaining end is connected to a flexible hydraulic line S3. The pre-lubrication system 2 is assembled by mounting a rack 212 to one end of a piston rod 211 and, fixing an actuator 2121 of a hydraulic cylinder 21 near the end of the rack 212. Microswitches 22 and 24 are respectively installed at the front and rear of the rack 212 and are triggered by the actuator 212. A pinion gear 232 is mounted to the end of a power output shaft 231, which is then enmeshed with the rack 212, and rotated by a drive motor 23 such that piston rod 21 1 of the hydraulic cylinder 21 is capable of reciprocal travel.

Figure 6:
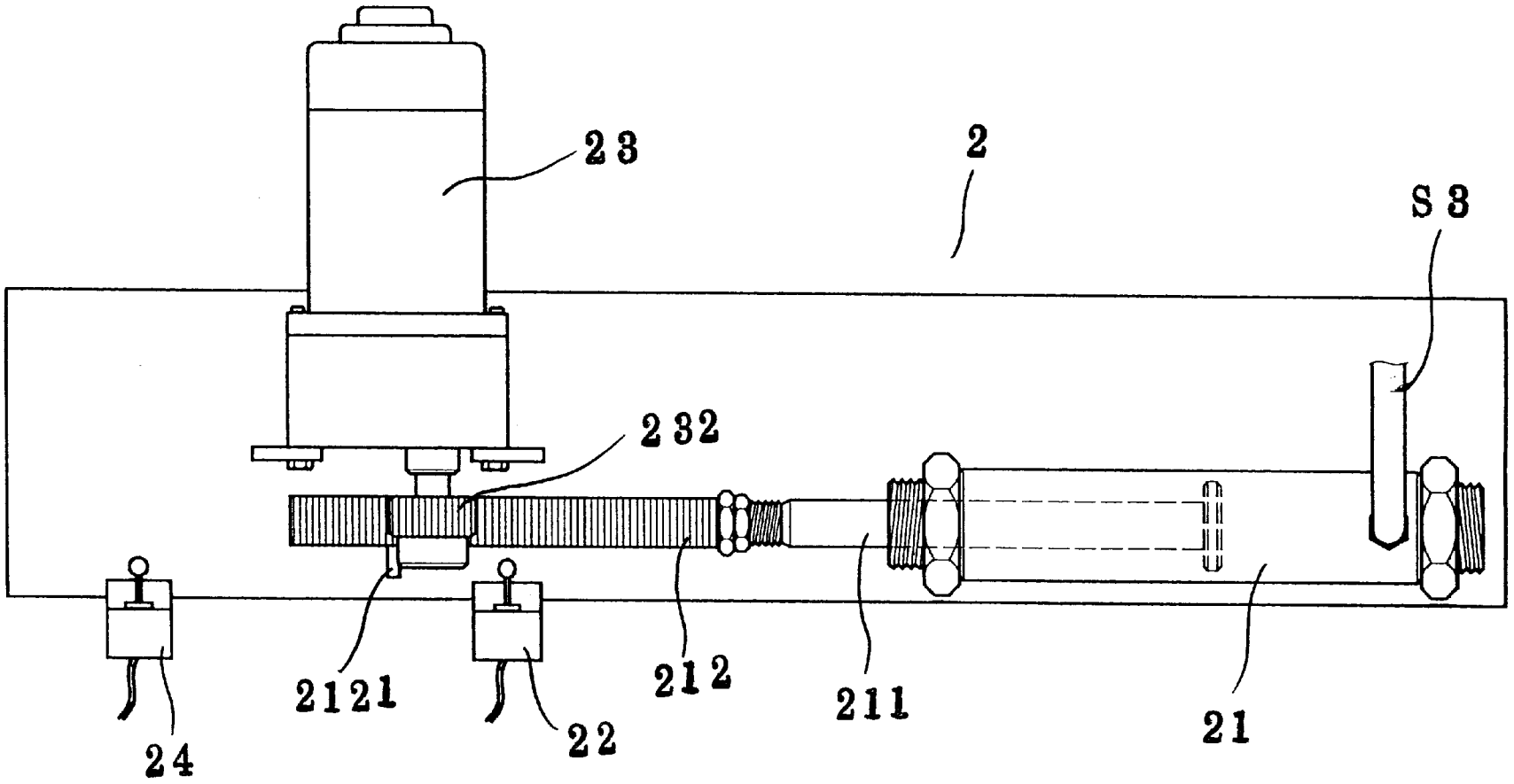
FIG. 6 is an orthographic drawing of the internal combustion engine pre-lubrication system of the invention herein that illustrates the pre-lubrication system after the internal combustion engine has been started and is operating at high rpm.
Figure 7:
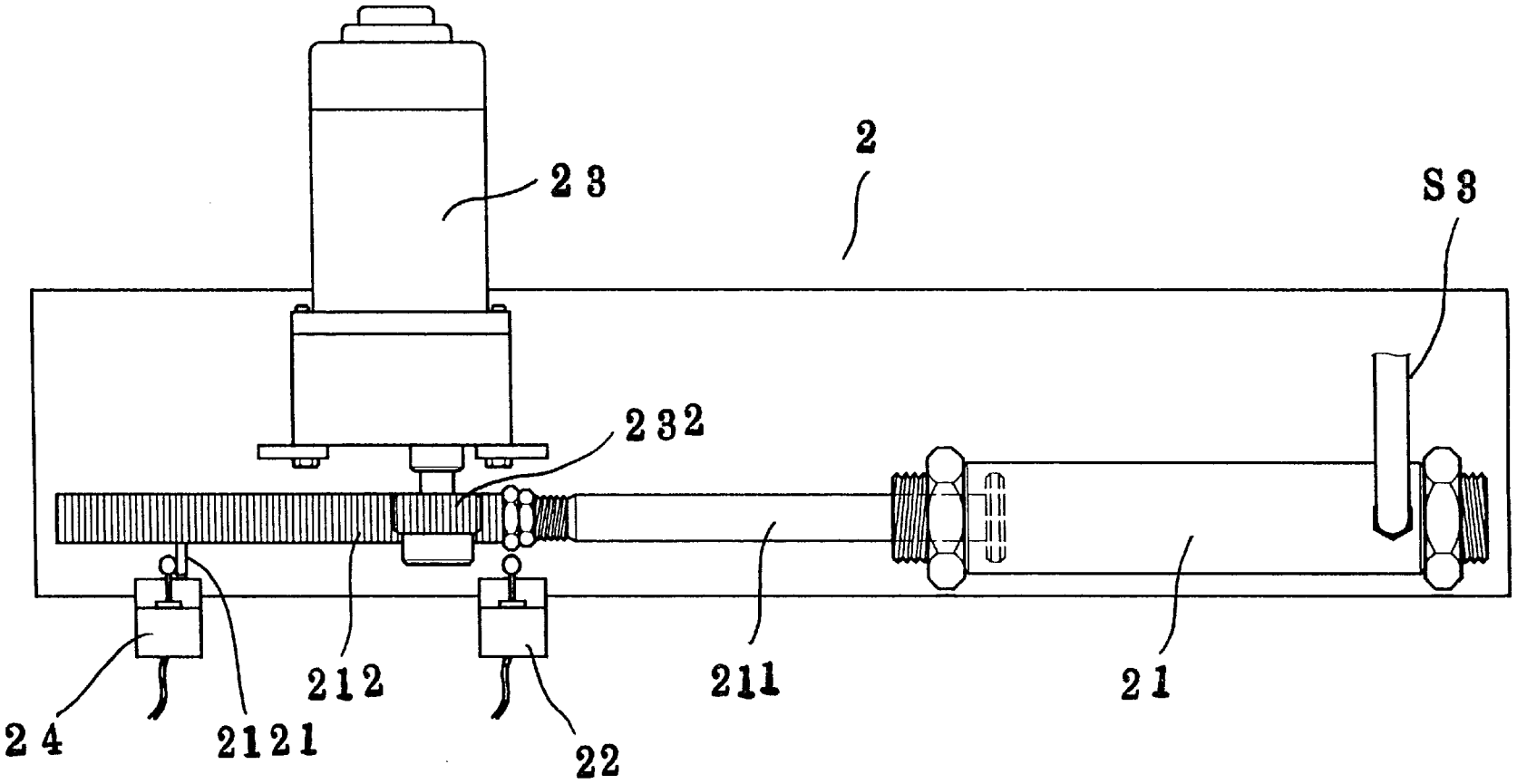
FIG. 7 is an orthographic drawing of the internal combustion engine pre-lubrication system of the invention herein that illustrates the hydraulic pressure rod of the pre-lubrication system returned to the rearmost position of travel after the internal combustion engine is rotating at normal speed.
Figure 8:
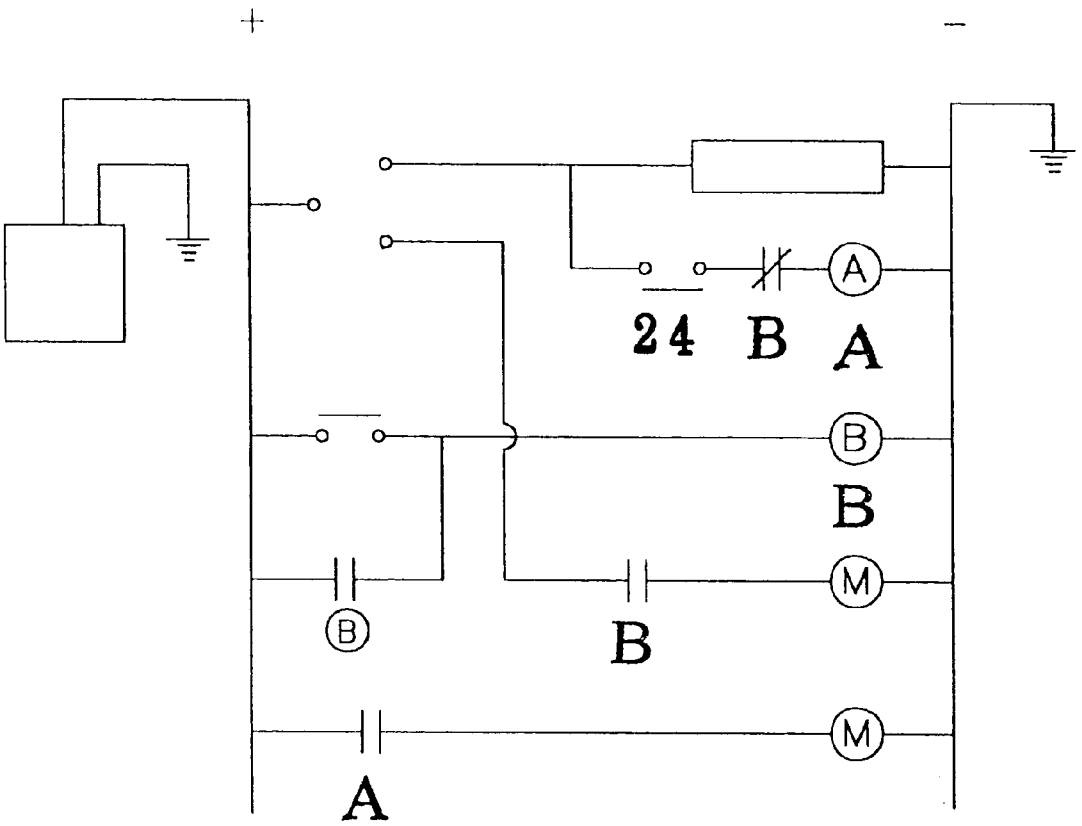
FIG. 8 is a schematic diagram of the internal combustion engine pre-lubrication system starting circuit of the invention herein.
Figure 9:
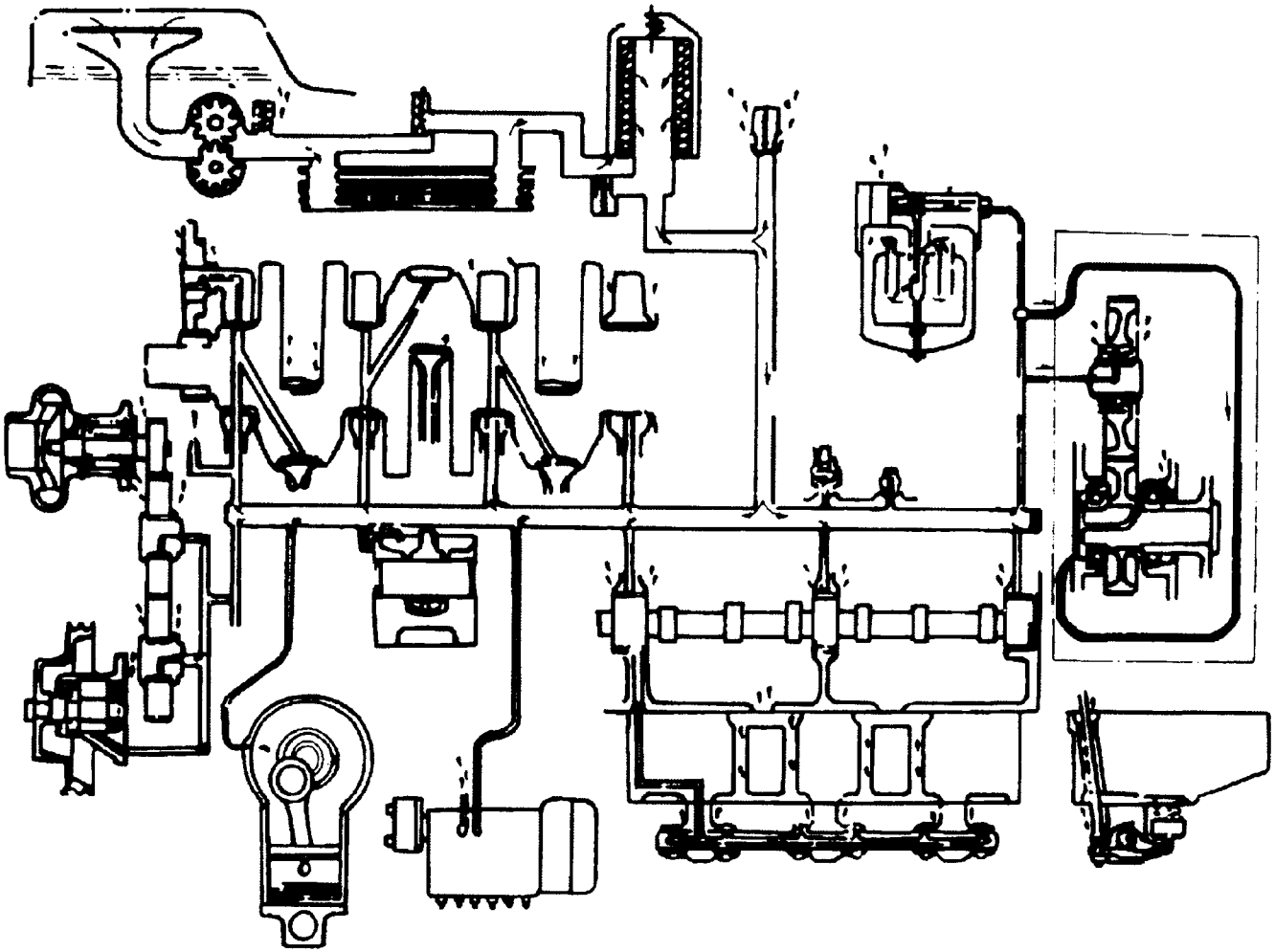
FIG. 9 is a schematic drawing of a lubrication system of an internal combustion engine.

After the foregoing structure is assembled and referring to FIGS. 1–9, when a key initiates the starting process, electric current is conducted to the high voltage ignition coil (an electromagnetic fuel valve in diesel engines) and the pre-lubrication system 2, with the relay A permitting electric current flow to the drive motor 23 in the pre-lubrication system 2, causing the drive motor 23 to rotate the pinion gear 232 mounted on the end of the power output shaft 231 and enmeshed in the rack 212 at the end of the hydraulic cylinder 21 piston rod 211, which results in the injection of the engine oil inside the hydraulic cylinder 21 into the main oil duct and causes the rack 212 to be withdrawn to its very end such that the actuator 2121 at the that end triggers the microswitch 22 (as shown in FIG. 2). When the microswitch 22 closes the relay B, the relay A stops the drive motor 23 of the pre-lubrication system 2, causing the engine starter motor relay circuit to activate by means of the key and the relay B (however, in order for the relay B to operate, the relay A must first bring into operation the driver motor 23 of the pre-lubrication system so that the drive motor 23 i.e., the engine starter motor can only be switched on after the operation of the pre-lubrication system 2 is completed). When starting is completed, the relay B keeps the relay A inoperative by preventing the supply of electricity to it while the engine reaches a working speed and, furthermore, after internal engine oil pressure is established and the task of component lubrication continues, a minute portion of the engine oil flows through the three-way connector S2 and into the hydraulic cylinder 21 of the pre-lubrication system 2 (as shown in FIG. 6), causing replenishment of the engine oil storage capacity (approximately 300 cc) in the hydraulic cylinder 21. The actuator 2121 at the end of the rack 212 conjoined to the piston rod 211 end contacts the microswitch 24 and returns to its original position, thereby becoming readied for the next starting process (as shown to FIG. 7). The present design of the pre-lubrication system provides, quicker engine component operation, more optimal piston compression, easier internal combustion engine starting, reduced frictional wear between engine components, more complete fuel combustion and thereby compliance with exhaust emission standards, and effectively prolongs overall internal combustion engine service life.

In summation of the foregoing section, the pre-lubrication system of the invention herein is capable of providing pre-lubrication functions, specifically the capability of substantially reducing frictional wear between internal combustion engine components that occurs for a brief instant when such engines are started due to insufficient lubrication and thereby effectively prolongs internal combustion engine service life.

What is claimed is:

1. An internal combustion engine pre-lubrication system for an internal combustion engine having an engine oil pump and an oil pan, an oil circulating system including a main oil duct and an engine starting system including a starter motor, the pre-lubrication system comprising:

a) a hydraulic cylinder having a first end connected to the main oil duct, and a movable piston rod extending out of a second end;

b) a rack affixed to the movable piston rod, the rack having an actuator extending therefrom;

c) an electric motor electrically connected to the engine starting system and having an output shaft with a pinion gear thereon, the pinion gear engaging the rack such that rotation of the output shaft and pinion gear causes linear movement of the rack and piston rod;

d) first and second microswitches electrically connected to the electric drive motor; and e) an electrical circuit connected to the engine starting system, the drive motor, and the first and second microswitches, whereby, when the internal combustion engine is turned off, the electric drive motor is actuated to move the piston rod to a first position in which a supply of oil is drawn into the hydraulic cylinder from the main oil duct, the first position being determined by contact of the actuator with the first microswitch, when the engine starting system is actuated, the drive motor moves the piston rod to a second position determined by contact of the actuator with the second microswitch so as to inject the oil in the hydraulic cylinder into the main oil duct before the starter motor starts the engine.

2. The internal combustion engine pre-lubrication system of claim 1 further comprising:

a) an oil pressure switch; and, b) a three way connector connected to the main oil duct, the first end of the hydraulic cylinder and to the oil pressure switch.

3. The internal combustion engine pre-lubrication system of claim 2 further comprising a flexible hydraulic line connected between the three way connector and the first end of the hydraulic cylinder.

* * * * *